US006547603B1

(12) United States Patent
Yu

(10) Patent No.: US 6,547,603 B1
(45) Date of Patent: Apr. 15, 2003

(54) ADAPTER FOR ELECTRICALLY CONNECTING SMART CARD TO MOTHERBOARD

(75) Inventor: Hung-Chi Yu, Hsi-Chihj (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/032,087

(22) Filed: Dec. 21, 2001

(30) Foreign Application Priority Data

Nov. 7, 2001 (TW) ..... 90219110 U

(51) Int. Cl.[7] ..... H01R 25/00
(52) U.S. Cl. ..... 439/638; 439/945
(58) Field of Search ..... 439/945, 946, 439/638

(56) References Cited

U.S. PATENT DOCUMENTS 5,030,130 A * 7/1991 Natsume ..... 439/374
6,071,150 A * 6/2000 Tang et al. ..... 439/638
6,099,354 A * 8/2000 Troyan ..... 439/638
6,132,223 A * 10/2000 Seeley et al. ..... 439/945
6,272,017 B1 * 8/2001 Klatt et al. ..... 439/945

* cited by examiner

*Primary Examiner*—Gary Paumen
(74) *Attorney, Agent, or Firm*—Wei Te Chung

(57) ABSTRACT

An adapter (10) is used to electrically connect a smart card (20) to a notebook computer (40) which defines an insert slot (40*a*) thereof. The adapter comprises an insulating housing (12) for inserting into the insert slot of the notebook computer. A plurality of terminals (15) include mating portions (15*a*) secured within terminal receiving channels (13*a*) defined in the housing, and contact portions (15*b*) for contacting an inserted smart card, thereby electrically connecting the smart card to the computer through the insert slot.

3 Claims, 3 Drawing Sheets

ADAPTER FOR ELECTRICALLY CONNECTING SMART CARD TO MOTHERBOARD

BACKGROUND OF THE INVENTION

1. Field of the Invention

The present invention relates to an adapter, and particularly to an adapter for electrically connecting a smart card to a motherboard mounted in a notebook computer.

2. Description of Relatrd Art

Recently, the smart card has been applied in many fields such as personal computers due to their excellent performance. However, for a notebook computer, the smart card can not be directly connected thereto because the notebook computer does not define the insert slot for insertion of the smart card. As we all know, it is almost impossible to define a new insert slot because of the small size of the notebook computer. Furthermore, even if the smart card insert slot could be defined in the notebook computer, it clearly increases the overall cost. Accordingly, defining a new insert slot for the smart card in the notebook seems not to be advisable at least at the present time. On the other hand, the notebook computer generally defines an insert slot at a side thereof for insertion of a PCMCIA card so as to transfer signals between a motherboard mounted in the notebook computer and the PCMCIA card. Therefore, how to apply the smart card in the notebook computer without needing to define a new insert slot, i.e., using existing PCMCIA card insert slot of the notebook computer, becomes a critical issue.

SUMMARY OF THE INVENTION

Accordingly, the object of the present invention is to provide an adapter for electrically connecting a smart card to a notebook computer using a PCMCIA card insertion slot of the notebook computer.

In order to achieve the object set forth, the adapter of the present invention includes a pair of half parts secured together. The pair of half parts define a receiving space therebetween. The adapter further includes an insulating housing and a plurality of terminals secured within the receiving space, respectively. Each terminal includes a mating portion secured within a terminal receiving channel of the housing and a contact portion protruding into the receiving space. In use, the adapter is first inserted into an insert slot defined at a side of a notebook computer, wherein the mating portions of the terminals contact with contacts of a complementary connector mounted in a motherboard in the notebook computer. Then the smart card is inserted into the receiving space, wherein a plurality of contact pads formed on a top surface of the smart card contact with the contact portions of the terminals in the receiving space, thereby electrically connecting the smart card to the motherboard of the notebook computer.

Other objects, advantages and novel features of the invention will become more apparent from the following detailed description of the preferred embodiment when taken in conjunction with the accompanying drawings.

DETAILED DESCRIPTION OF THE INVENTION

Figure 1:
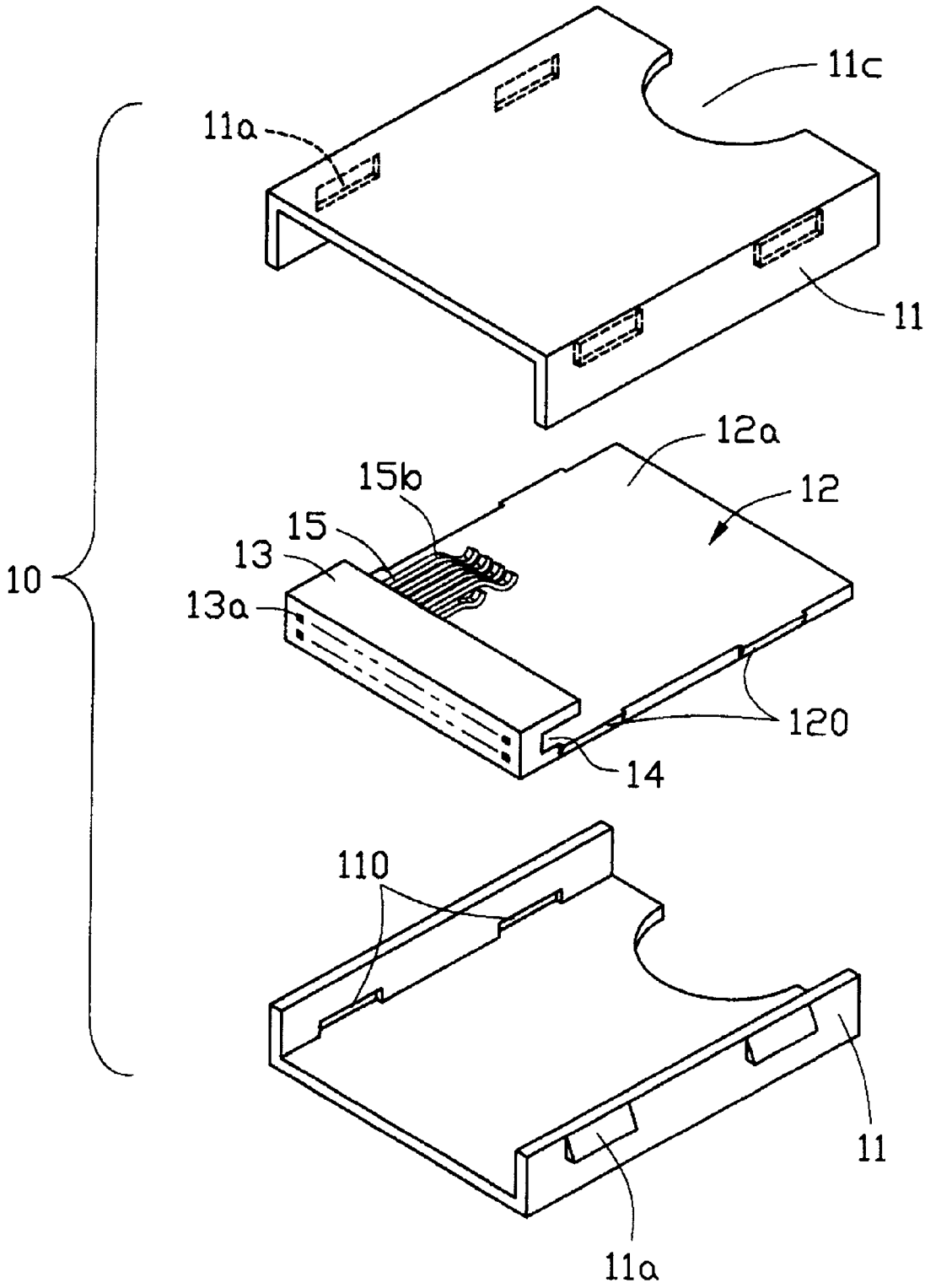
FIG. 1 is an exploded view of an adapter of the present invention.

Reference will now be made to the drawing figures to describe the present invention in detail.

Figure 2:
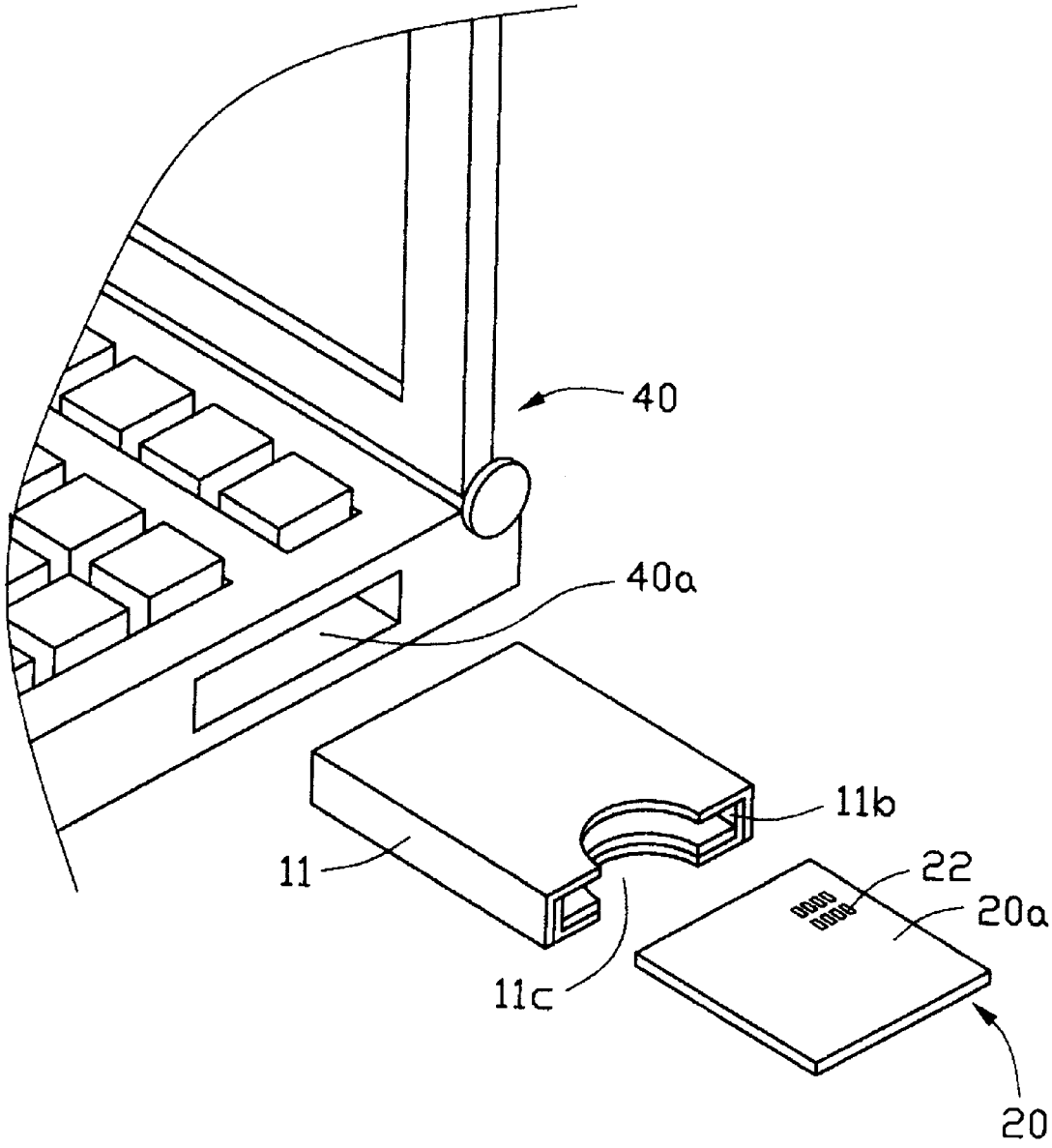
FIG. 2 is an exploded view of a notebook computer, a smart card and the assembled adapter of the present invention.

Referring to FIGS. 1 and 2, an adapter 10 of the present invention is used for electrically connecting a smart card 20 to a notebook computer 40. The computer 40 defines an insert slot 40*a* at a side thereof.

The adapter 10 includes a pair of half parts 11 vertically secured together by securing portions 11*a*. The pair of parts 11 together define an elongate receiving space 11*b* therebetween and a semicircular recess 11*c* at an end thereof. The pair of half parts 11 are formed to have a predetermined length greater than the depth of the insert slot 40*a* of the computer 40 so that a rear end of the pair of half parts 11 is disposed out of the insert slot 40*a* of the computer 40. The smart card 20 includes a plurality of contact pads 22 on a top surface 20*a* thereof and also has a predetermined length which is greater than the depth of the receiving space 11*b* but smaller than that of the pair of half parts 11.

The adapter 10 further includes a flat insulating housing 12 secured to the pair of half parts 11 by the engagement of the securing portions 120 and 110. The housing 12 has an upwardly extending block 13 at a front end thereof. The block 13 defines a plurality of terminal receiving channels 13*a*. A top portion of the block 13 protrudes toward a rear end opposite to the first end of the housing. Thus, a securing groove 14 is defined between the protruding portion of the block 13 and an upper surface 12*a* of the housing 12.

A plurality of terminals 15 are received within the receiving space 11*b*. Each terminal 15 has a mating portion (not shown) secured within a corresponding terminal receiving channel 13*a*, and a contact portion 15*b* protruding into the receiving space 11*b* and being spaced from the upper surface 12*a* of the housing 12.

Figure 3:
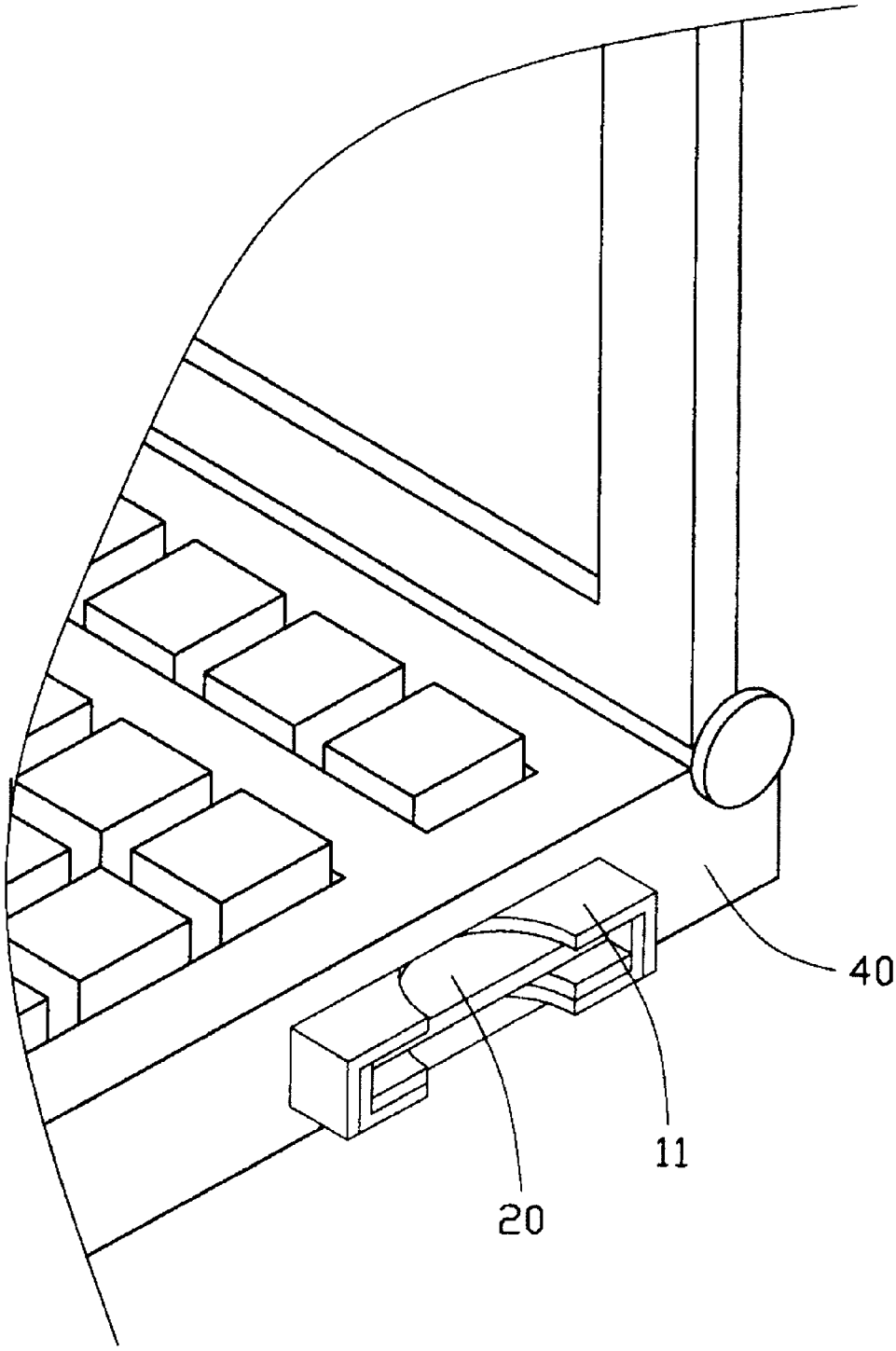
FIG. 3 is a view similar to FIG. 2 but showing that the smart card and the adapter are assembled to the notebook computer.

Referring to FIG. 3, in use, the assembled adapter 10 is first inserted into the insert slot 40*a* of the notebook computer 40, wherein the mating portions 15*a* of the terminals 15 mate with corresponding terminals 42 in the notebook computer 40. The smart card 20 is then inserted into the receiving space 11*b* of the adapter 10 wherein a frontmost portion of the smart card 20 is disposed in the groove 14 of the adapter 10. The contact pads 22 of the smart card 20 contact with contact portions 15*b* of the terminals 15. Rear ends of the pair of half parts 11 and the smart card 20 are both exposed outside of the insert slot 40*a* of the computer 40. The rear end of the smart card 20 is located in the semicircular recess 11*c* of the pair of half parts 11.

It is noted that the housing 12 of the adapter 10 can be formed integrally with one of the pair of half parts 11, or being formed of two halves to be further assembled together. In addition, the pair of half parts 11 of the adapter 10 can be also formed integrally.

A first advantage of the present invention is that the smart card 20 is electrically connected to the notebook computer 40 by the adapter 10 without needing to define a new insert slot in the notebook computer, thereby decreasing the overall costs.

A second advantage of the present invention is that the adapter 10 can be readily withdrawn from the insert slot 40*a* of the computer 40 because the rear end of the smart card 20 is situated in the recess 11*c* outside of the notebook computer 40.

A third advantage of the present invention is that the smart card 20 exposed out of the notebook computer 40 is covered by the rear end of the pair of half parts 11, thereby preventing the smart card from being touched by an external force.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An interconnection system for use with a PCMCIA card and a Smart card, comprising:

a data storage device defining an insert slot in one face thereof, said insert slot being configured to receive said PCMCIA card therein;

an adaptor including a housing defining an outer contour in compliance with that of said PCMCIA card and an inner configuration in compliance with that of said Smart card;

said housing defining on a front portion thereof two rows of passageways for receiving a PCMCIA connector which is located at an inner end of the insert slot; and a plurality of contacts disposed in some of said passageways, respectively, with front ends thereof adapted to be mechanically and electrically engaged with the PCMCIA connector;

wherein rear ends of said contacts are arranged in a pattern in compliance with conductive pads on said Smart card, respectively.

2. The system as claimed in claim 1, wherein said housing is inserted into the insert slot with the front portion mated with the PCMCIA connector and with thereof a rear portion extending out of said insert slot.

3. The system as claimed in claim 2, wherein said housing defines a recess for easy access to the Smart card in said housing from an exterior in a vertical direction perpendicular to said insert slot.

* * * * *